US006463758B1

(12) United States Patent
Le Bot

(10) Patent No.: US 6,463,758 B1
(45) Date of Patent: Oct. 15, 2002

(54) PROCESS AND APPARATUS FOR SEPARATING AIR BY CRYOGENIC DISTILLATION

(75) Inventor: Patrick Le Bot, Vincennes (FR)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/280,081

(22) Filed: Mar. 29, 1999

(30) Foreign Application Priority Data

Mar. 31, 1998 (FR) ..... 98 03988

(51) Int. Cl.[7] ..... F25J 3/04
(52) U.S. Cl. ..... 62/654
(58) Field of Search ..... 62/646, 940, 654

(56) References Cited

U.S. PATENT DOCUMENTS 3,094,402 A 6/1963 Armstrong et al.
3,905,201 A * 9/1975 Coveney et al. ..... 62/13
4,595,405 A 6/1986 Agrawal et al.
5,475,980 A * 12/1995 Grenier et al. ..... 62/24
5,596,885 A 1/1997 Grenier
5,735,142 A * 4/1998 Grenier ..... 62/646

FOREIGN PATENT DOCUMENTS

EP 0 576 314 A1 12/1993
EP 0 641 983 A1 3/1995

* cited by examiner

*Primary Examiner*—William C. Doerrler
*Assistant Examiner*—Malik N. Drake
(74) *Attorney, Agent, or Firm*—Young & Thompson

(57) ABSTRACT

A first air stream is expanded in a first turbine (D1) before being mixed with a second air stream (104) in order to form a third stream (105). At least part of the third stream is sent to a second turbine (D2) and then to the double column.

Figure 1:
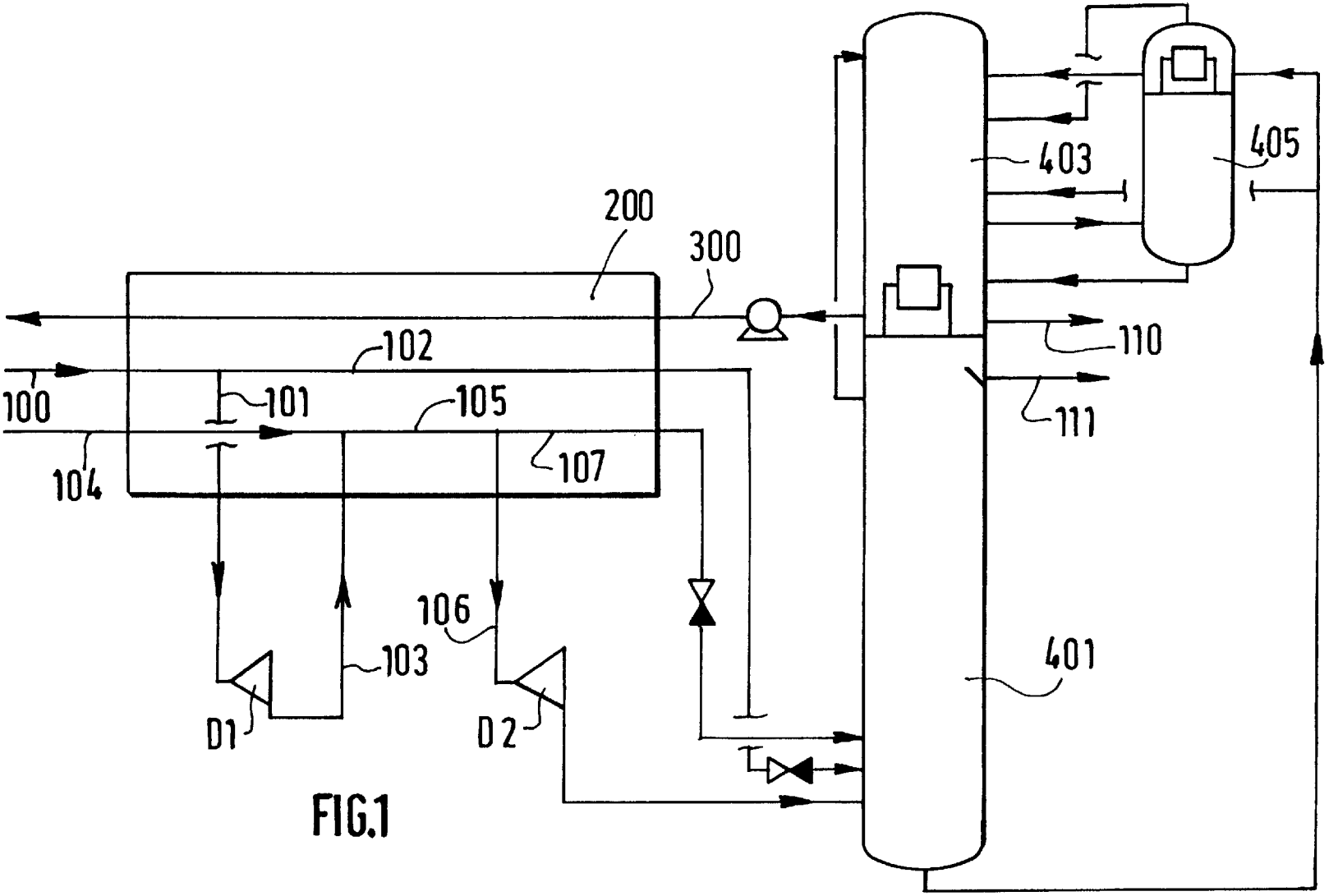

The stream expanded in the first turbine is smaller than the stream expanded in the second turbine.

13 Claims, 3 Drawing Sheets

PROCESS AND APPARATUS FOR SEPARATING AIR BY CRYOGENIC DISTILLATION

The present invention relates to a process and an apparatus for separating air by cryogenic distillation.

In order to produce liquid from a double air-separation column, it is known to use two turbines in series in order to expand the air.

U.S. Pat. No. 3,905,201 describes an air separation process which produces liquid nitrogen and liquid oxygen, using two turbines in series; the second turbine expands air, which is then either vented to atmosphere or is sent to the low-pressure column.

EP-A-0,420,725 describes a system- in which a Claude turbine produces air intended for the medium-pressure column and air which is warmed before being expanded and either vented to atmosphere or sent to the low-pressure column.

EP-A-0,542,539 describes an air separation process using two air turbines in series, the second of which is a blowing turbine.

The outlet temperature of the first turbine is also at the inlet temperature of the second turbine.

EP-0,641,983 describes an air separation process using two air turbines in series with the air from the first turbine being warmed before the air is sent into the second turbine.

The object of this invention is to reduce the specific energy or the air separation process, by eliminating as far as possible the deviations from the exchange diagram of the main heat exchanger.

According to the invention, a process for separating air by cryogenic distillation is provided in which a first air stream is cooled, at least part of the first cooled stream is expanded in a first turbine, the stream expanded in the first turbine is mixed with a second air stream in order to form a third stream, at least part of the third stream is expanded in a second turbine, at least part of the stream expanded in the second turbine is introduced into a rectification column of a double column, the air in the double column is separated into oxygen-rich and nitrogen-rich fluids and a fluid in liquid form is produced as the final product.

According to other aspects of the invention,

- the stream expanded in the first turbine is cooled before it is expanded in the second turbine,
- the stream expanded in the first turbine is smaller than the stream expanded in the second turbine,
- at least part of the stream expanded in the second turbine is introduced into the medium-pressure column or the low-pressure column,
- the stream intended for the first turbine is at a pressure of at least 15 bar,
- the second air stream is at a pressure of at least 6 bar,
- the stream expanded in the second turbine consists of at least 70% air,
- the pressure at the outlet of the second turbine is slightly above the pressure in the medium-pressure column,
- the inlet temperatures of the first and second turbines are intermediate temperatures of the main exchanger,
- part of the first stream and/or part of the third air stream are/is cooled further in the main exchanger and are/is liquefied at the cold end,
- at least one optionally pressurized liquid stream vaporizes in the main exchanger,
- a stream of fluid from the low-pressure column of the double column feeds as argon column and an argon stream is drawn off from the latter,
- the stream expanded by the second turbine leaves it as a two-phase fluid.

According to another aspect of the invention, an apparatus for separating air by cryogenic distillation is provided, which comprises;

- a main heat exchanger;
- a double air-distillation column;
- means for sending an air stream into a first turbine;
- means for mixing the air expanded in the first turbine with a second air stream in order to form a third air stream;
- means for sending at least part of the third air stream to a second turbine;
- means for sending air expanded in the second turbine to the double column; and
- means for drawing off a liquid product from the double column.

According to other aspects of the invention, an apparatus is provided which comprises means for cooling the third air stream before at least part of it is sent to the second turbine.

Figure 2:
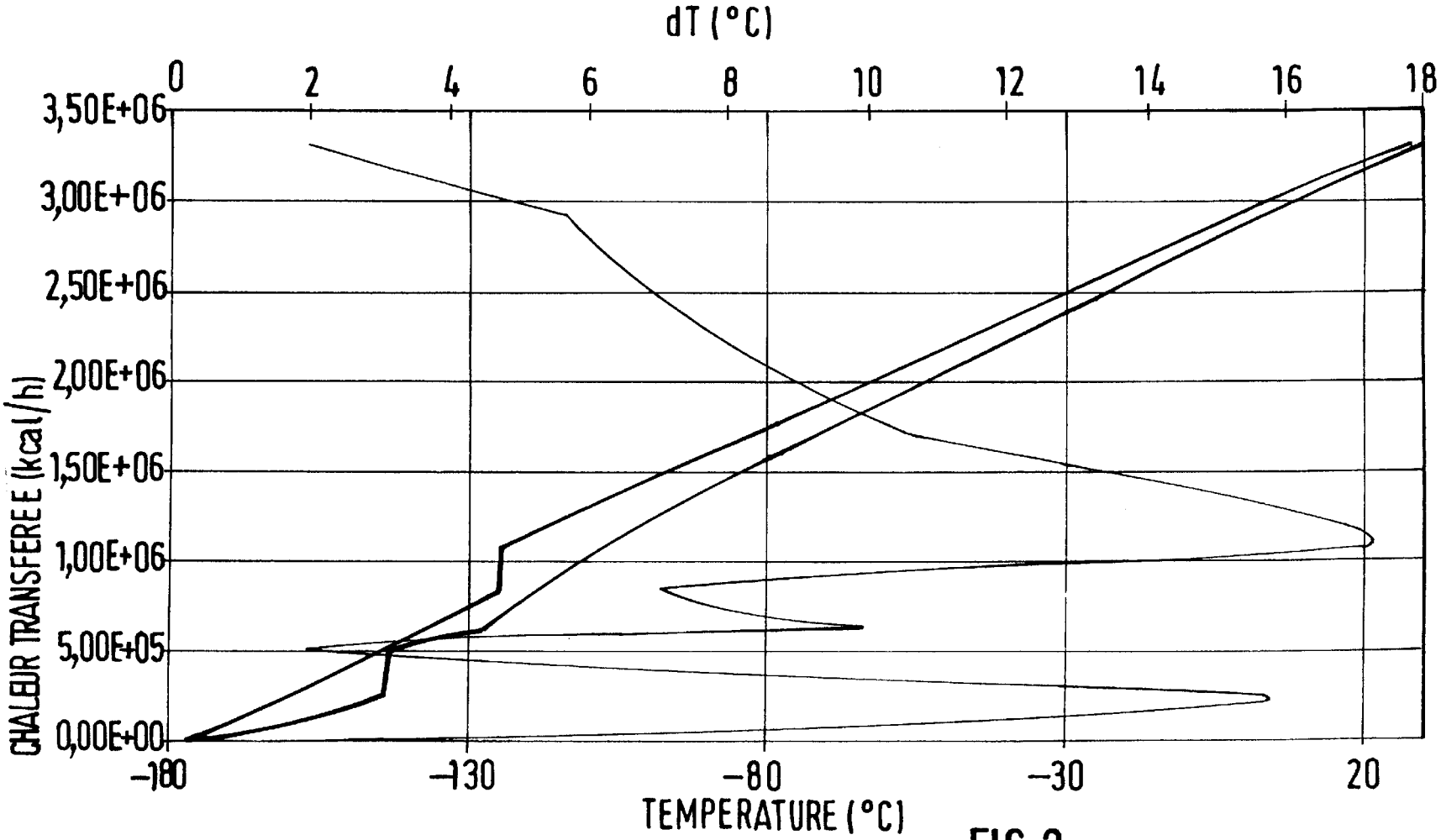
Figure 3:
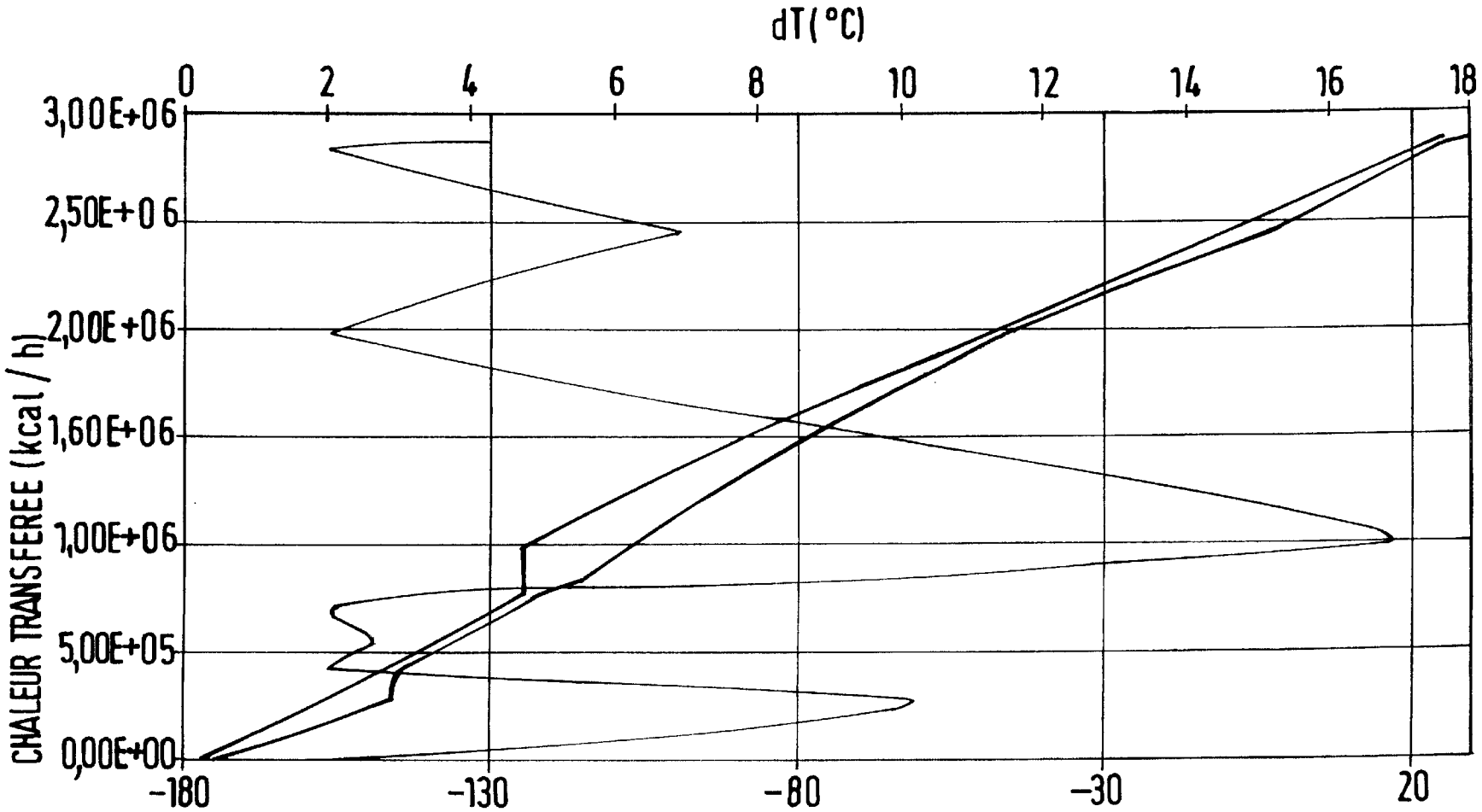

The invention will be described in greater detail, with reference to the figures, of which FIG. 1 is a diagram of the process according to the invention, FIG. 2 is an exchange diagram for a process according to EP-A-0,420,725, and FIG. 3 is an exchange diagram for a process according to the invention.

In FIG. 1, 35% of the aid enters the exchanger 200 at more than 30 bar and in any case at a pressure markedly higher than that in the medium-pressure column. The first stream 100 is cooled to −10° C. and separated into a stream 102 which represents 15% of the air and a stream 101 which represents 20% of the air. The stream 102 cools in the exchanger and leaves from the cold end.

The stream 101 is expanded in the turbine Dl to 30 bar and at −50° C. before being sent back to the exchanger and mixed with a second stream 104 (65% of the air) at 30 bar. The mixed streams form a third stream 105 which is cooled to −100° C. before being divided into two streams 106, 107. The stream 106 (70% of the air) is expanded by the turbine D2 to the pressure in the medium-pressure column before being injected into it. The stream leaving the turbine D2 is optionally a two-phase stream. The stream 107 (15% of the air) continues to be cooled in the exchanger 200.

A stream of liquid oxygen 300 from the double column 400 is pressurized by a pump and evaporates in the exchanger 200. Alternatively, this stream could be replaced by several liquid streams at different pressures, or streams of liquid nitrogen or of liquid argon.

Liquid oxygen 110 and/or liquid nitrogen 111 are/is drawn off from the double column 400.

Optionally, the low-pressure column feeds an argon column 405.

The turbines D1, D2 may optionally be coupled to air compressors.

The column 403 may operate under pressure, i.e. at a pressure of above 1.5 bar.

The columns 401, 403, 405 may contain trays or structured packings.

What is claimed is:

1. Process for separating air by cryogenic distillation, in which a first air stream (100) is cooled, at least part (101) of the first cooled stream is expanded in a first turbine (D1), the stream expanded in the first turbine (D1) is mixed with a second air stream (104) in order to form a third stream (105), at least part (106) of the third stream is expanded in a second turbine (D2), at least part of the stream expanded in the second turbine is introduced into a rectification column of a double column (400), the air in the double column is separated into oxygen-rich and nitrogen-rich fluids and a fluid in liquid form is produced as the final product.

2. Process according to claim 1, in which the third stream (105) is cooled before at least part of it is expanded in the second turbine (D2).

3. Process according to claim 1, in which the stream (101) expanded in the first turbine is smaller than the stream (106) expanded in the second turbine.

4. Process according to claim 1, in which said double column comprises a medium-pressure column and a low-pressure column and at least part of the stream expanded in the second turbine (D2) is introduced into the medium-pressure column.

5. Process according to claim 1, in which said double column comprises a medium-pressure column and a low-pressure column and the stream (101) intended for the first turbine (D1) is at a pressure markedly higher than the pressure in the medium-pressure column.

6. Process according to claim 1, in which the pressure at the outlet of the second turbine (D2) is slightly above the pressure in the medium-pressure column.

7. Process according to claim 1, in which the first air stream is cooled in a main exchanger and the inlet temperatures of the first and second turbines (D1, D2) are intermediate temperatures of the main exchanger.

8. Process according to claim 1, in which the first air stream is cooled in a main exchanger and part (102) of the first stream and/or part (107) of the third stream are/is cooled further in the main exchanger and are/is liquefied at the cold end.

9. Process according to claim 1, in which the first air stream is cooled in a main exchanger and at least one optionally pressurized liquid stream vaporizes in the main exchanger.

10. Process according to claim 1, in which a stream of fluid from the low-pressure column of the double column feeds an argon column (405) and an argon stream is drawn off from the latter.

11. Apparatus for separating air by cryogenic distillation, comprising:

a main heat exchanger (200);

a double air-distillation column;

means (100, 101) for sending an air stream into a first turbine (D1);

means for mixing the air expanded in the first turbine with a second air stream (104) in order to form a third air stream (105);

means (103, 105, 106) for sending at least part of the third air stream to a second turbine (D2);

means (103, 105, 106) for sending air expanded in the second turbine to the double column; and means for drawing off a liquid product from the double column (400).

12. Apparatus according to claim 11, comprising means for cooling the air coming from the first turbine (D1) before it is sent into the second turbine (D2).

13. Apparatus according to claim 11, in which an argon column (405) is fed with a fluid coming from the double column.

* * * * *